United States Patent [19]

Gongwer

[11] 4,004,309

[45] Jan. 25, 1977

[54] HYDRODYNAMIC STABILIZING DEVICE

[75] Inventor: Calvin A. Gongwer, Glendora, Calif.

[73] Assignee: The Bendix Corporation, North Hollywood, Calif.

[22] Filed: Apr. 5, 1976

[21] Appl. No.: 673,770

[52] U.S. Cl. ..... 9/8 R

[51] Int. Cl.[2] ..... B63B 21/52

[58] Field of Search ..... 9/8 R, 9; 340/2, 3 PS

[56] References Cited

UNITED STATES PATENTS

| | | | |
|---|---|---|---|
| 3,022,462 | 2/1962 | Keiper, Jr. | 340/2 |
| 3,115,831 | 12/1963 | Suter | 340/2 |
| 3,290,642 | 12/1966 | Mason et al. | 340/2 |
| 3,500,209 | 3/1970 | Fletcher et al. | 9/8 R |

*Primary Examiner*—George E. A. Halvosa
*Assistant Examiner*—Jesus D. Sotelo
*Attorney, Agent, or Firm*—Robert C. Smith; William F. Thornton

[57] ABSTRACT

A hydrodynamic instrumentation or transducer structure is adopted for deployment into the ocean or similar large body of water in such manner that it is caused to descend essentially vertically from a buoy at the end of a line of substantial length, such as 1000 feet or more. The essentially cylindrical structure includes a cylindrical extension of essentially the same diameter as the primary structure whose purpose is to house at least the line and possibly also the buoy structure, as well as carrying a plurality of brackets at its outboard end which secure the outboard ends of a corresponding number of resilient fin members attached to the primary structure such that the entire assembly may be carried in a cylindrical space little larger in diameter than the primary structure. A ring clamp secures the cylindrical extension to the primary structure, and after the assembly is placed in the water a pressure-responsive device responds to a small amount of water pressure to release this clamp, thereby permitting the cylindrical extension to be released and releasing the fins to spring outwardly to act as tail fins causing the primary structure to descend with its opposite end down. A diagonal bend at the outboard ends of the fins serves to cause the structure to spin on its axis as it descends, thus providing for an essentially vertical path and minimizing lateral drift.

5 Claims, 7 Drawing Figures

HYDRODYNAMIC STABILIZING DEVICE

The invention herein described was made in the course of or under a contract with the Navy Department.

BACKGROUND OF THE INVENTION

There are many applications in which it may be desired to deploy a housing containing a sonar transducer or an instrumentation package into the ocean at the end of a line which may be 1,000 feet long or more. Such instrumentation packages may be expendable and therefore need to be quite inexpensive and would not justify sophisticated hydrodynamic design. One known method for assuring reasonable stability for objects dropped into the ocean is to place the center of gravity substantially below the center of buoyancy. This arrangement is not always practical.

Applicant has been concerned with a problem of assuring verticality in the deployment of an electro-acoustical transducer package deployed from an aircraft where it is carried in a bomb bay or other location permitting very little increase in diameter beyond that required for the package itself. When placed in the ocean, it is desired that the transducer drop vertically and not drift off at an angle since it is important to know that the physical location of the transducer is essentially directly below that of a buoy visible in the water. Since this transducer package is essentially cheap and expendable, it does not warrant a sophisticated hydrodynamic design to assure such verticality. The housing is essentially cylindrical in configuration, and it will be recognized that any irregularities in the surface of such cylinder, particularly where the center of gravity is not below the center of buoyancy, can cause the cylindrical housing to drift laterally.

SUMMARY OF THE INVENTION

It has been recognized that a type of stationary tail fin structure might very well aid in providing the desired verticality, but such tail fins as normally supplied would unacceptably increase the diameter and storage requirements for the housing. It has also been determined that, in addition to the normal operation of tail fins, such fins could be canted to provide a predictable spin for the housing. This would tend to further assure a vertical drop. It has been determined that a comparatively inexpensive solution to this problem resides in the provision of a plurality of aluminum straps or fins which are secured such that they are held very closely to the sides of the cylindrical housing during deployment but, after the housing is located in the water, are released such that they spring outwardly away from the housing. By canting the outboard ends of these fins in a manner somewhat similar to the angle of an airplane propeller, the desired spin will be imparted to the housing which results in a reliable vertical path. Those skilled in the art will recognize that the materials chosen for these fins must be such that a memory of the desired curved or as-deployed configuration must remain in the material even as secured to the side of the housing. Thus the initial deformation to the desired curvature must exceed the elastic limits of the material which can be a high grade of aluminum or steel, among others, and the subsequent deformation close to the sides of the housing must not exceed the elastic limits of the material. These fin members will therefore spring outwardly in a very predictable fashion and consistently so that there is not a substantial difference in the size of circle traversed by the different fins. A small differential in the effective radii of these members of perhaps 5% will not adversely affect operation, but significantly more than this should be avoided.

DESCRIPTION OF THE PREFERRED EMBODIMENT

Figure 1:
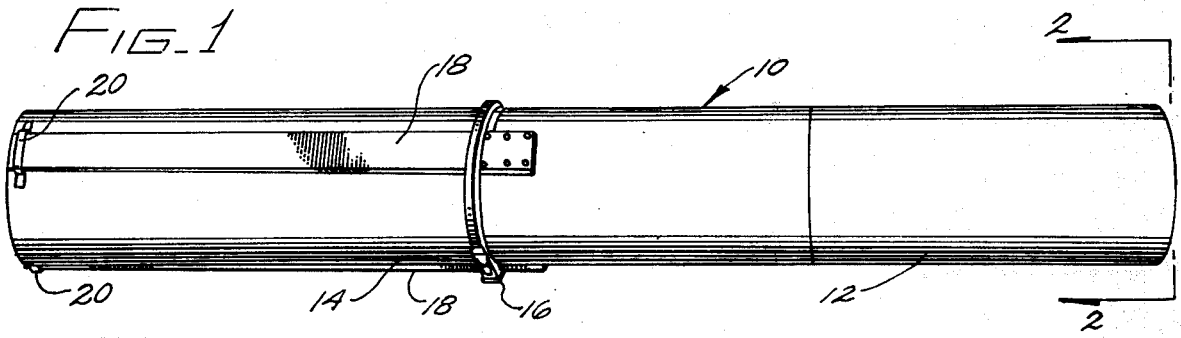
FIG. 1 is a plan view of an instrumentation package according to my invention as carried in an aircraft or other vehicle prior to deployment in the ocean.

Referring now to FIG. 1, numeral 10 designates an instrumentation package or transducer structure to be deployed at substantial depth in the ocean and consists of the cylindrical housing 12 having fastened thereto a second cylindrical housing 14 which is removable therefom with removal of a compression ring clamp 16 which is designed to be released after the entire assembly is in the water by means (not shown) responsive to water pressure. Typically, such a release mechanism could consist of a pressure-responsive bellows or member which closes a switch, thereby igniting a squib which severs the fastening on ring clamp 16. Fastened to housing 12 are a plurality of fin members 18 which are secured tightly against the side of housing 14 by means of brackets 20. Housing 14, which is removable and which is discarded upon the operation of the release means releasing ring clamp 16, may contain a substantial length of line such as 1,000 feet of nylon cord attached to an inflatable buoy or, alternatively, the buoy may be carried externally to housing 10 but also fastened to such a line.

Figure 2:
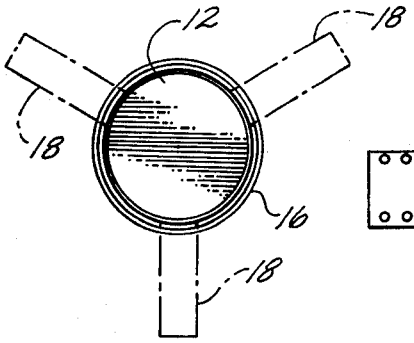
FIG. 2 is an end view of the housing of FIG. 1 showing the fins in deployed position in phantom.

FIG. 2 is an end view of the housing 12 showing in phantom the fins 18 as they would appear after the expendable housing 14 has been removed.

Figure 3:
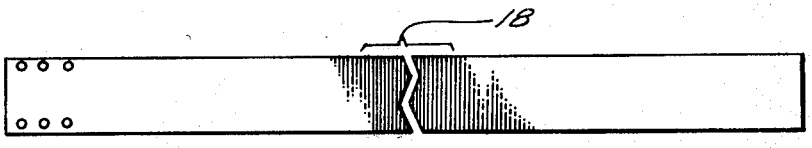
FIG. 3 is a plan view of one of the fins shown in the FIG. 1 device.
Figure 3A:
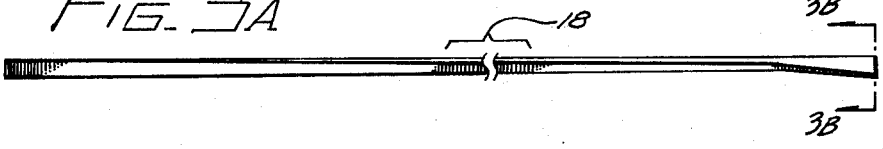
FIG. 3A is a side view of the fin shown in FIG. 3.
Figure 3B:
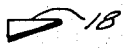
FIG. 3B is an end view of the fin shown in FIGS. 3 and 3A.
Figure 3C:
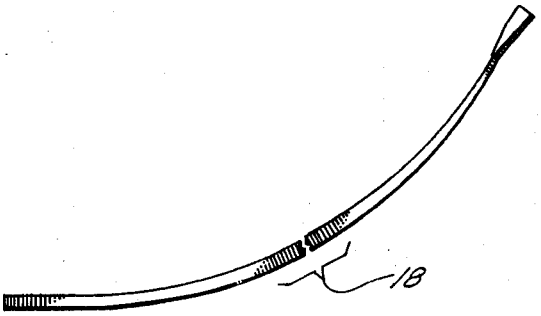
FIG. 3C is a side view of the fin as shown in FIGS. 3, 3A and 3B but deformed into its as-deployed position.

FIGS. 3, 3A and 3B show top, side and end views, respectively, of the fins 18 as they are initially formed. While not absolutely essential, it will be recognized that these fins are tapered from the bolted or riveted end outwardly, and then the outward end is twisted at an angle as shown, particularly in FIGS. 3A and 3B. After the fin is formed as shown in FIGS. 3, 3A and 3B, it is bent to form a curved configuration as shown in FIG. 3C such that it tends to retain this configuration. When the fins 18 as shown in FIG. 3C are riveted to the housing 12 and the housing 14 is attached to housing 12, fins 18 are forced into a position such that they lie flat against the side of housing 14 with the outboard end retained under brackets 20 (see FIG. 1).

Figure 4:
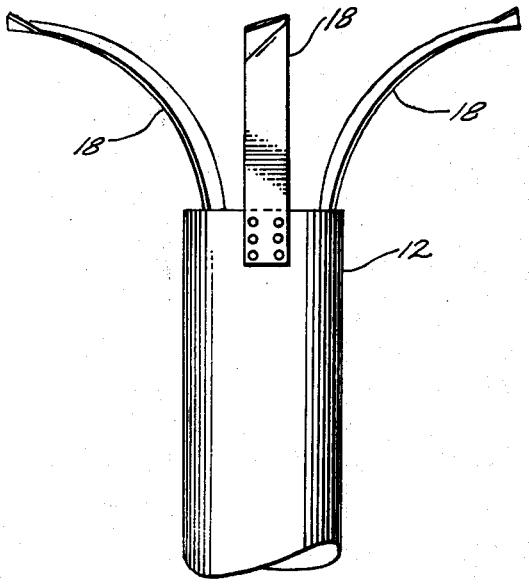
FIG. 4 is a fragmentary side view of the device shown in FIG. 1 with the upper part of the housing removed and the fins shown in phantom in their as-deployed position.

In operation, when the assembly 10 is dropped into the water it will begin to sink, and at some relatively slight depth the ring clamp 16 is released, thereby causing the expendable housing 14 along with brackets 20 and ring clamp 16 to be separated from housing 12. Separation from housing 14 and brackets 20 will cause the fins 18 to spring outwardly as shown in FIG. 4, and as housing 12 sinks in the water the force of the water past the fins 18, and particularly the twisted ends of these fins, will cause the entire assembly to spin or rotate around its axis. This spinning action tends to minimize lateral drifting of housing 12 and causes it to drop straight down until it reaches the end of its tethering rope.

From the foregoing, it will be appreciated that the structure described will drop vertically even though the center of gravity is substantially displaced from an optimum position below the center of buoyancy. The fin arrangement shown makes it possible to store and carry the assembly in a tubular compartment having a diameter very little greater than that of the housing, and yet in operation the fins can spring outwardly to provide a retarding function while also biased to provide the desired spinning action. With this fin structure, the amount of velocity retard or resistance is controlled more by the diameter of the circle described by the ends of the fins than by the number of fins. Thus, the three comparatively long fins shown are preferable to a larger number of fins which would describe a smaller circle. The fin structure described is comparatively inexpensive to fabricate in that relatively inexpensive materials will provide acceptable predictability as to the distance the fins spring outwardly. While the canted fin tips described above are probably the simplest and least expensive way to implement the desired spinning action, this can also be accomplished by installing the fins 18 at a slight angle with respect to the housing 12.

I claim:

1. A structure for deployment into the ocean or similar large body of water comprising a generally cylindrical housing, a generally cylindrical removable housing fastened to said first named housing as an extension thereof, a plurality of brackets attached to said removable housing at the end thereof remote from its attachment to said cylindrical housing, a releasable ring-shaped clamp securing said removable housing to said cylindrical housing, and a plurality of fin members each of which is attached at one end to said cylindrical housing at its end nearest said ring-shaped clamp, said fin membrs extending along the length of said removable housing and secured at their opposite ends under said brackets, said fin members being formed of elongated flat strips of metal which are deformed over substantially their entire length to curve outwardly away from said cylindrical housing when not secured under said brackets;

such that when said structure is deployed in the water said clamp is released, permitting said removable housing to be separated from said cylindrical housing and said fins to spring outwardly, and means causing said cylindrical housing to rotate around its axis as it travels downwardly in the water.

2. A structure for deployment into the ocean or other large body of water as set forth in claim 1 wherein the tips of said fins are bent diagonally to cause said cylindrical housing to rotate on its axis as it travels downwardly in the water.

3. A structure for deployment into the ocean or other large body of water as set forth in claim 1 wherein said fins are tapered in thickness from the end of attachment to said cylindrical housing to its outboard end.

4. A structure for deployment into the ocean or other large body of water as set forth in claim 3 wherein three such fin members are attached to and evenly spaced around said cylindrical housing.

5. A structure for deployment into the ocean or other large body of water as set forth in claim 4 wherein three of said brackets are formed on said cylindrical removable housing.

* * * * *